US006656058B2

(12) United States Patent
Thompson et al.

(10) Patent No.: US 6,656,058 B2
(45) Date of Patent: Dec. 2, 2003

(54) TORQUE MINIMIZATION APPARATUS FOR A GOLF CLUB

(76) Inventors: James Thompson, 3827 Paxton Ave. #233, Cincinnati, OH (US) 45209; Ronald J. Thompson, 110 Stangesy Ridge, Ft. Thomas, KY (US) 41075

( * ) Notice: Subject to any disclaimer, the term of this patent is extended or adjusted under 35 U.S.C. 154(b) by 0 days.

(21) Appl. No.: 10/062,865

(22) Filed: Jan. 31, 2002

(65) Prior Publication Data

US 2003/0144072 A1 Jul. 31, 2003

(51) Int. Cl.[7] ..... A63B 53/00; A63B 53/10; A63B 53/12

(52) U.S. Cl. ..... 473/318

(58) Field of Search ..... 428/36.3, 36.9; 264/635; 156/187, 188; 473/316–323, 559, 561–562, 564–568; 43/18.1, 18.5; 280/819

(56) References Cited

U.S. PATENT DOCUMENTS

| | | | | | |
|---|---|---|---|---|---|
| 3,461,593 | A | * | 8/1969 | Martuch | 43/18.5 |
| 4,948,132 | A | * | 8/1990 | Wharton | 473/246 |
| 6,033,328 | A | * | 3/2000 | Bellefleur et al. | 473/561 |
| 6,257,997 | B1 | * | 7/2001 | Doble et al. | 473/516 |

FOREIGN PATENT DOCUMENTS

WO WO01/26752 * 4/2001

* cited by examiner

*Primary Examiner*—Stephen Blau
(74) *Attorney, Agent, or Firm*—Don Halgren

(57) ABSTRACT

A torque reduction and swing improvement arrangement for a golf club. The arrangement comprises a hallow elongated golf club shaft with a longitudinal axis therewithin, having a handle portion at an upper end thereof, and a golf club head at a lower end of the shaft. A torque reduction arrangement of at least one ribbon of flexible, flat, planar material is disposed longitudinally within the shaft, the ribbon extending from the upper end of the shaft into the lower end thereof. The ribbon is secured within the shaft by a securement arrangement within the shaft.

12 Claims, 2 Drawing Sheets

TORQUE MINIMIZATION APPARATUS FOR A GOLF CLUB

BACKGROUND OF THE INVENTION

1. Field of the Invention

This invention relates to golf clubs and more particularly to arrangements within that golf club to minimize the twisting and the torque effect upon the hitting of a golf ball.

2. Prior Art

Golf club design is directed towards two goals. The first goal is to maximize impact energy to the golf ball, so that the struck ball flies as far as possible. The second goal is for that golf ball, when hit, to fly as straight and true as possible. The prior art has attempted to reach these goals primarily by the design of the club head, the composition of the club head face, or the composition of the club shaft itself. Other prior art devices relate to swing training arrangements intended to physiologically program the golfer's swing.

In order to increase the probability of impacting a force that causes a golf ball to fly straight, the face of the club must address the ball in a perfectly perpendicular attitude. Torque of the club must be taken into consideration. Torque is the rotation of the club shaft transferred to the club head-end face that causes the club face to impact the golf ball in a less than perpendicular manner. This torque is created by the mechanics unique to each golfer's swing. Torque in the shaft, and an offset club face is what causes the ball to fly in less than a straight flight, as either in a hook or in a slice.

It is an object of the present invention to provide a golf club shaft that will minimize or eliminate any torque unique to each golfer.

It is a further object of the present invention to minimize or eliminate the characteristics of a golf club that would affect the ball going in anything else than a straight ball trajectory.

It is a further object of the present invention to provide a golf club having a club head speed that would reach maximum acceleration at the point that the golf club face impacts the golf ball.

It is a further object of the present invention to provide a golf club shaft that will increase the shaft flexibility but reduce or eliminate golf club shaft rotational torque.

BRIEF SUMMARY OF THE INVENTION

The present invention utilizes a material for the golf club shaft to improve golf club shaft head speed and to minimize golf club shaft rotational torque. Such material is Nitinol (NiTi) that is a unique shape memory alloy of nickel and titanium. Nitinol is a material which will re-attain its original shape once its constraining forces are removed. Nitinol is one component of the present invention that imparts flexibility to the golf club shaft. The Nitinol material is responsible for both the flexibility of the shaft and the torque retardation of that golf club shaft.

The present invention utilizes one or more ribbons of Nitinol which may, when arranged according to the principles of the present invention, flex only in the direction of the large flat front and any parallel back face of the golf club head. A Nitinol ribbon cannot flex from side to side because of the I-beam principles unique to a flat ribbon design.

In the present invention, one or more elongated ribbons of super elastic material, for example preferably Nitinol or another metal or a superelastic plastic, are arranged along side one another. The Nitinol ribbons have an upper end and a lowermost end. The length of the longest ribbons may extend from about 44 to 54 inches and the ribbons may have a thickness of preferably about 0.001 to about 0.1 inches. In a preferred embodiment, the ribbons of Nitinol have a central long ribbon being sandwiched by a first pair of slightly shorter Nitinol ribbons, those three ribbons being sandwiched by a yet slightly shorter third pair of Nitinol ribbons, each set of pairs of Nitinol ribbons having a common upper end and each pair of Nitinol ribbons having lowermost ends spaced apart from the other lowermost ends of the other pairs of ribbons.

A preferred embodiment of the present invention comprises the multiple pairs of varying lengths of Nitinol ribbons sandwiched together and held together by a plurality of spaced apart restraining bands. The sandwich of multi-length Nitinol bands in a preferred embodiment are arranged within the hollow tubular shaft of the golf club, the upper end of the Nitinol band sandwich being disposed within the upper end of the handle portion of the golf club shaft. The lower end of the Nitinol band sandwich comprising the stepped down or reduced thickness of the Nitinol sandwich, residing in the lower end of the golf club shaft. The golf club shaft having at its lower end a golf club head. The golf club head has a generally planar face which is utilized to strike and impact the golf ball at the lowermost arcuate portion of the golfer's swing.

The band of Nitinol ribbons sandwiched together are held securely within the hollow tapered shaft of the golf club by internal support means therewithin. Such internal support means may comprise a plurality of opposed spaced apart shelves or ledges within the club shaft. Those ledges or shelves would have progressively narrower gaps therebetween, proceeding towards the lower end of the shaft.

The bands of Nitinol are wider than they are thick. The wide portions of each Nitinol band defines a planar face thereof. The golf club head has a planar face thereon. The planar face of the Nitinol bands, in the present invention are preferably arranged parallel to the planar face of the golf club head, or to a horizontal dividing the sweet spot of the face. This planar arrangement with the stepped configuration of the Nitinol ribbon pairs sandwiching one another permits a front-back flexion with in combination with the golf club head weight, to create a "whip" action of the golf club head to allow more golf club head speed and greater ball flying distance upon impact thereof. The reverse-graduated pairs of Nitinol ribbon bands tightly engaging the shaft (or comprising the shaft) prevent the golf club shaft torqueing. The combination of increased flexibility at the lower or distal end of the golf club shaft and the reduced shaft/head torque would create increased golf ball flight distance and greater likelihood of a straight flight of that golf ball.

A further embodiment of the internal support arrangement of the Nitinol ribbons therewithin, may comprise a sleeve of flexible plastic material enveloping the ribbons and filing any space between the ribbons and the inner walls of the shaft, the sleeve may in a further embodiment may also comprise the external surface of the shaft.

A yet further preferred embodiment of the present invention is contemplated by an adjustable juncture between the lowermost end of the golf club shaft and a receptive fitting in the golf club head into which the lower end of the golf club shaft mates. By rotating the plane of the Nitinol ribbons with respect to the plane of the face at the golf club head prior to the golf club being swung, may provide for compensation to erratic swinging conditions by the golfer. Such improved flexure and torque elimination would thus result.

The invention thus comprises a torque reduction and swing improvement arrangement for a golf club comprising a hollow elongated golf club shaft with a longitudinal axis therewithin, and having a handle portion at an upper end thereof, and a golf club head at a lower end of the shaft. A torque reduction arrangement of at least one ribbon of flexible planar material is disposed longitudinally within the shaft, the ribbon extending from the upper end of the shaft into the lower end thereof. The least one ribbon is secured within the shaft by a securement arrangement within the shaft. The torque reduction arrangement may comprise a plurality of ribbons of material within the shaft. The at least one ribbon may be formed of superelastic material. The superelastic material may be comprised of Nitinol. The plurality of ribbons may comprise a central elongated ribbon sandwiched between at least one pair of shorter ribbons. The plurality of ribbons may have an upper end at a common location at an upper end in the handle portion of the shaft. The plurality of ribbons may be held together by a band arranged therearound. The torque reduction arrangement may be supported within the shaft of the club by an arrangement of shelves pinchably disposed therein. The securement arrangement of said club may comprise a sleeve of engaging material disposed therearound. The sleeve of engaging material may be comprised of a sleeve of plastic. The club head has a planar surface thereon for impacting a ball, and the ribbon of planar material defines a planar surface which is disposed parallel to the planar surface of the club head. The golf club head may be rotatable with respect to the longitudinal axis of the shaft of the club to affect a displacement of the plane of the at least one ribbon relative to the planar surface of the head. The head and the lower end of the shaft have a splined mating relationship permitting the adjustable rotation therebetween.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
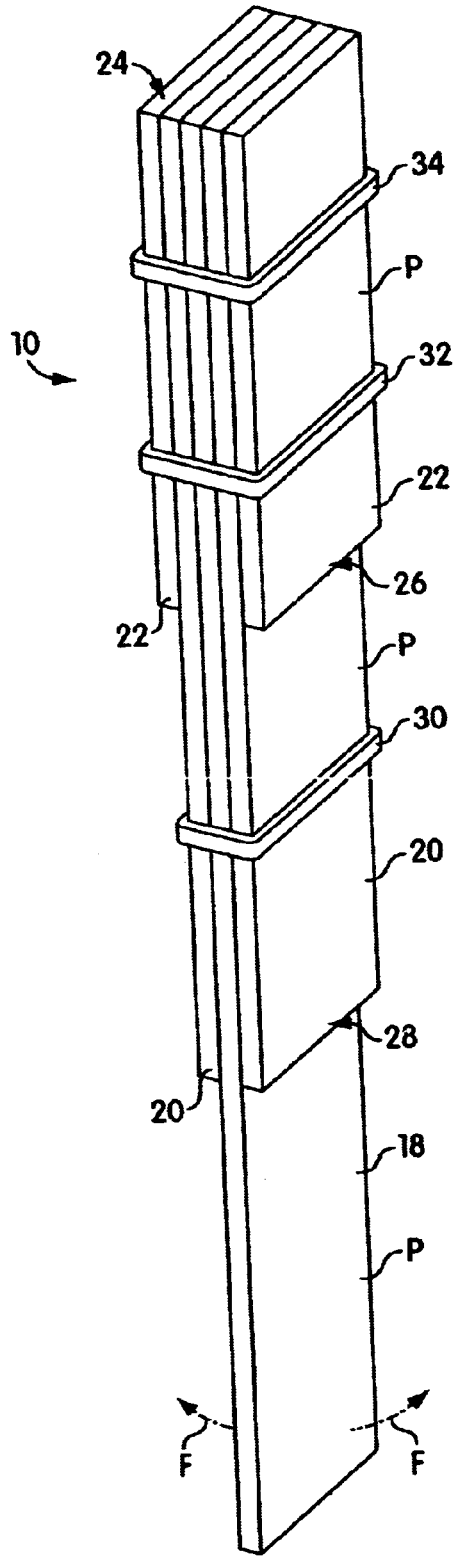
FIG. 1 is a perspective view of a plurality of super elastic ribbons banded together.
Figure 2:
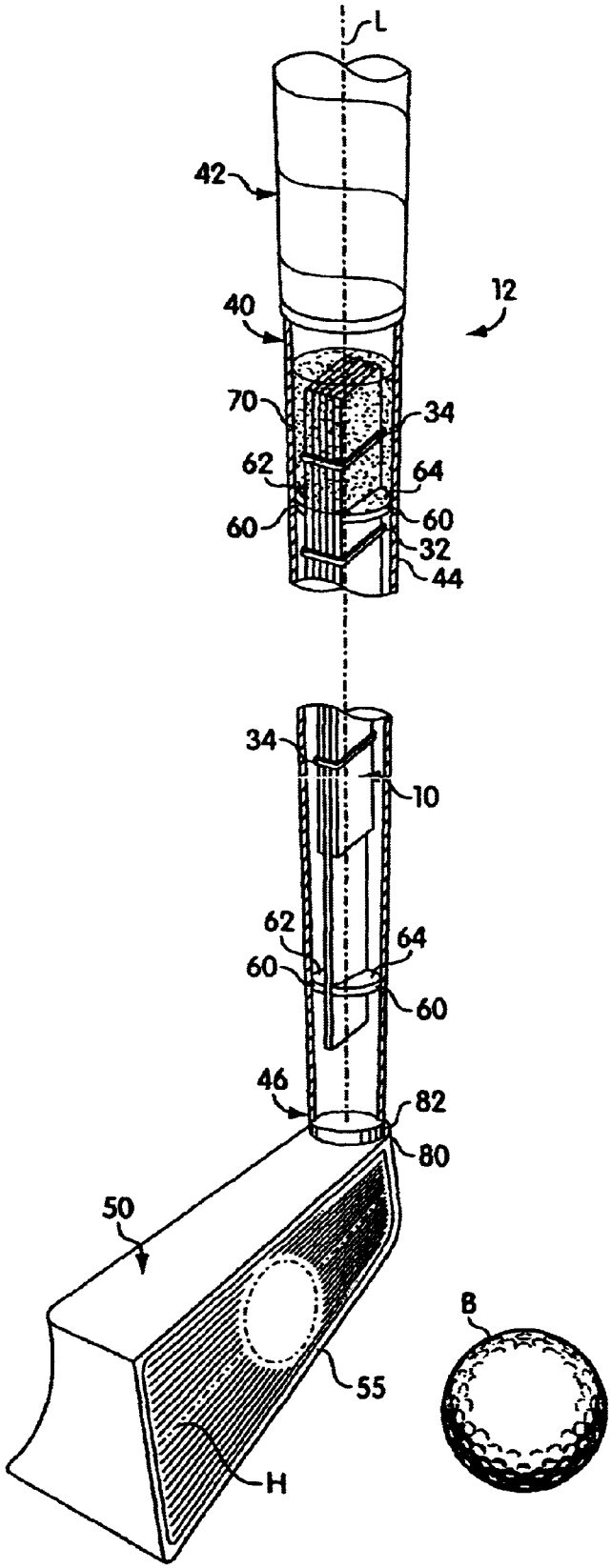
FIG. 2 is a perspective view of a golf club with a plurality of super elastic bands arranged therewithin according to the principles of the present invention.

Referring now to the drawings in detail, and particularly to FIG. 1, the is shown the present invention which comprises a utilizes one or more ribbons of Nitinol 10 which may, when arranged according to the principles of the present invention, flex only in the direction of the large flat front and any parallel back face of the golf club head of a golf club 12 in which it is placed, as may be seen in FIG. 2. A Nitinol ribbon cannot flex from side to side because of the I-beam principles unique to a flat ribbon design.

In the present invention, one or more elongated flat, relatively flexible (in one plane only) ribbons of super elastic material, for example preferably Nitinol or another metal or a super-elastic plastic 10, are arranged along side one another. The Nitinol ribbons 10 have an upper end and a lowermost end as described hereinbelow. The length of the longest ribbons 10 may extend from about 44 to 54 inches and the ribbons may have a thickness of preferably about 0.001 to about 0.1 inches.

In a preferred embodiment, the ribbons of Nitinol 10 have a central, long ribbon 18 being sandwiched by a first pair of slightly shorter Nitinol ribbons 20, those three ribbons 18 and 20 being sandwiched by a yet slightly shorter third pair of Nitinol ribbons 22, each long ribbon 18 and each set of pairs of Nitinol ribbons 20 and 22 having a common upper end 24 and each pair of Nitinol ribbons 22 and 20 having lowermost ends 26 and 28 spaced apart from one another lowermost ends, as may be seen in FIG. 1 and FIG. 2.

A preferred embodiment of the present invention comprises the multiple pairs of varying lengths of Nitinol ribbons 10 sandwiched together and held together by a plurality of spaced apart restraining bands 30, 32 and 34. The sandwich of multi-length Nitinol bands 10 in a preferred embodiment are arranged within the hollow tubular shaft 36, along its longitudinal axis "L" of the golf club 12, the upper end of the Nitinol band 10 sandwich being disposed within the upper end 40 of the handle portion 42 of the shaft 44 of the golf club 12. The lower end of the Nitinol band sandwich 10 comprises the stepped down or reduced thickness of the Nitinol sandwich 10, residing in the lower end 46 of the golf club shaft 44. The golf club shaft 44 has a golf club head 50 at its lower end 46. The golf club head 50 has a generally planar face 52 which is utilized to strike and impact the golf ball "B" at the lowermost arcuate portion of the golfer's swing.

The band of Nitinol ribbons 10 sandwiched together are held securely within the hollow tapered shaft 44 of the golf club 12 by internal support means 60 therewithin. Such internal support means 60 may comprise a plurality of opposed spaced apart shelves or ledges 62 and 64 within the hollow club shaft 44. Those support means 60 such as for example, the ledges or shelves 62 would have progressively narrower gaps "G" therebetween, as may be seen in FIG. 2, proceeding from the upper end 40 towards the lower end 46 of the shaft 44.

The bands of Nitinol 10 are wider than they are thick. The wide portions of each Nitinol band 18, or 20 or 22 defines a planar face "P" thereof. The golf club head 50 has a planar face 55 thereon. The planar faces "P" of each of the Nitinol bands 18, 20 and 22, in the present invention are preferably arranged parallel to the planar face 55 of the golf club head 50, or to a horizontal "H" dividing the sweet spot of the face 55. This planar arrangement with the stepped configuration of the Nitinol ribbon pairs sandwiching one another thus permits a front-back flexion, as indicated by the arrows "F" in FIG. 1, with in combination with the weight of the golf club head 50, to create a "whip" action of the golf club head 50 to allow more golf club head speed and greater ball flying distance upon impact thereof. The reverse-graduated pairs of Nitinol ribbon bands tightly engaging the shaft (or comprising the shaft) prevent the golf club shaft torqueing. The combination of increased flexibility at the lower or distal end of the golf club shaft and the reduced shaft/head torque would create increased golf ball flight distance and greater likelihood of a straight flight of that golf ball "B".

A further embodiment of the internal support arrangement 60 of the Nitinol ribbons 18, 20 and 22 therewithin may comprise a sleeve of flexible plastic material 70 enveloping the ribbons 18, 20 and 22 and filing any space between the ribbons and the inner walls of the shaft 44. The sleeve 70 may in a further embodiment may also comprise the external surface of the shaft 44.

A yet further preferred embodiment of the present invention is contemplated by an adjustable juncture 80 between the lowermost end 46 of the golf club shaft 44 and a receptive fitting 82 such as a spline relationship in the golf club head 50 into which the lower end 46 of the golf club shaft 44 mates. By rotating the plane of the Nitinol ribbons 10 with respect to the plane of the face 55 at the golf club head 50 prior to the golf club 12 being swung, may provide for compensation to erratic swinging conditions by the golfer. Such improved flexure and torque elimination would thus result.

We claim:

1. A torque reduction and swing improvement arrangement for a golf club comprising a hollow elongated golf club shaft with a longitudinal axis therewithin, and having a handle portion at an upper end portion thereof, and a golf club head at a lower end portion of said shaft, comprising:

a torque reduction arrangement comprised of a plurality of ribbons of flexible planar material disposed longitudinally within said shaft, at least one of said plurality of ribbons extend from said upper end portion of said shaft into said lower end portion thereof;

said at least one ribbon secured within said shaft by a securement arrangement within said shaft, and wherein said plurality of ribbons comprises a central elongated ribbon sandwiched between at least one pair of shorter said ribbons.

2. The arrangement for a golf club as recited in claim 1, wherein said at least one ribbon is formed of super-elastic material.

3. The arrangement for a golf club as recited in claim 2, wherein said super-elastic material is comprised of Nitinol.

4. The arrangement for a golf club as recited in claim 1, wherein said plurality of ribbons have an upper end at a common location at an upper end portion in said handle portion of said shaft.

5. The arrangement for a golf club as recited in claim 4, wherein said plurality of ribbons are held together by a band arranged therearound.

6. The arrangement for a golf club as recited in claim 1, wherein said torque reduction arrangement is supported within said shaft of said club by an arrangement of shelves pinchably disposed therein.

7. The arrangement for a golf club as recited in claim 1, wherein said securement arrangement of said club comprises a sleeve of engaging material disposed therearound.

8. The arrangement for a golf club as recited in claim 7, wherein said sleeve of engaging material comprises a sleeve of plastic.

9. The arrangement for a golf club as recited in claim 1, wherein said club head has a planar surface thereon for impacting a ball, and said ribbon of planar material defines a planar surface which is disposed parallel to said planar surface of said club head.

10. The arrangement for a golf club as recited in claim 9, wherein said golf club head is rotatable with respect to said longitudinal axis of said shaft of said club to affect a displacement of said plane of said at least one ribbon relative to said planar surface of said head.

11. The arrangement for a golf club as recited in claim 10, wherein said head and said lower end of said shaft have a splined mating relationship permitting said adjustable rotation therebetween.

12. A torque reduction and swing improvement arrangement for a golf club comprising a hollow elongated golf club shaft with a longitudinal axis therewithin, and having a handle portion at an upper end portion thereof, and a golf club head at a lower end portion of said shaft, comprising:

a torque reduction arrangement a plurality of ribbons comprised of flexible planar material disposed longitudinally within said shaft, at least one of said plurality of ribbons extending from said upper end portion of said shaft into said lower end portion thereof;

said at least one ribbon secured within said shaft by a securement arrangement within said shaft comprising an arrangement of shelves pinchably disposed therein and wherein said golf club head is rotatable with respect to said longitudinal axis of said shaft of said club to affect a displacement of said plane of said at least one ribbon relative to said planar surface of said head, said head and said lower end of said shaft having a splined mating relationship permitting said adjustable rotation therebetween.

* * * * *